US007591399B2

(12) United States Patent
Hortin et al.

(10) Patent No.: US 7,591,399 B2
(45) Date of Patent: Sep. 22, 2009

(54) VARIABLE FLOW WATER DISPENSER FOR REFRIGERATOR FREEZERS

(75) Inventors: Gregory G. Hortin, Henderson, KY (US); Ronald L. Voglewede, St. Joseph, MI (US); Marcus R. Fischer, St. Joseph, MI (US); Patrick J. Boarman, Evansville, IN (US); Bradley L. Kicklighter, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 11/690,184

(22) Filed: Mar. 23, 2007

(65) Prior Publication Data

US 2007/0175919 A1 Aug. 2, 2007

Related U.S. Application Data

(62) Division of application No. 10/861,569, filed on Jun. 4, 2004, now Pat. No. 7,210,601.

(51) Int. Cl.
*B67D 5/06* (2006.01)

(52) U.S. Cl. ..... 222/144.5; 222/14; 222/52; 222/64; 222/129.1; 222/146.6; 62/389

(58) Field of Classification Search ..... 222/14, 222/52, 59, 64, 639–640, 129.1, 129.2, 129.3, 222/129.4, 144.5, 146.6, 385, 95, 105; 62/389–390; 239/428.5, DIG. 19
See application file for complete search history.

(56) References Cited

U.S. PATENT DOCUMENTS

| | | | | |
|---|---|---|---|---|
| 5,492,250 | A * | 2/1996 | Sardynski | 222/108 |
| 6,355,177 | B2 * | 3/2002 | Senner et al. | 210/739 |
| 6,751,525 | B1 * | 6/2004 | Crisp, III | 700/241 |
| 6,766,656 | B1 * | 7/2004 | Crisp et al. | 62/389 |
| 7,168,592 | B2 * | 1/2007 | Crisp et al. | 222/129.1 |
| 7,210,601 | B2 * | 5/2007 | Hortin et al. | 222/144.5 |

* cited by examiner

*Primary Examiner*—Frederick C. Nicolas
(74) *Attorney, Agent, or Firm*—Kirk W. Goodwin; Robert L. Judd; Michael D. Lafrenz

(57) ABSTRACT

A variable flow rate water dispenser mounted on a refrigerator door is provided that can dispense water at user selected flow rates. The water dispenser includes a nozzle for dispensing water from a dispenser housing on a refrigerator door and a user adjustable flow control. The user adjustable flow control can include a variable flow rate water valve or a plurality of water valves that can have different flow rates and can be operated separately or in combination to provide different flow rates. The user adjustable flow control can alternately include a variable flow pump for controlling flow of water to the nozzle at a user selected flow rate. The refrigerator can include a reservoir inside or outside the refrigerator. The reservoir can be connected to a source of water and automatically filled or can be manually filled. The nozzle can include a flow straightener or aerator to minimize splashing.

10 Claims, 10 Drawing Sheets

VARIABLE FLOW WATER DISPENSER FOR REFRIGERATOR FREEZERS

CROSS-REFERENCE TO RELATED APPLICATION

This application is a divisional of U.S. application Ser. No. 10/861,569, filed Jun. 4, 2004, this application hereby incorporated by reference.

BACKGROUND OF THE INVENTION

1. Field of the Invention

The present invention relates to water dispensers that can be located on the outer surface of a refrigerator door.

2. Description of the Related Art

Ice and water dispensers are known for use in household refrigerator freezers. Variable flow liquid dispensers are also known.

SUMMARY OF THE INVENTION

The present invention is directed to a variable flow rate water dispenser mounted on a refrigerator door. The dispenser can include a dispenser nozzle and a user adjustable flow control and an actuator to allow the user to dispense water at a flow rate selected by the user.

The adjustable flow control can include one or more water valves having variable or different flow rates that can be operated alone or in combination to provide plural flow rates from the dispenser nozzle.

Alternately, the adjustable flow control can include a pump connected to a reservoir to dispense water from the dispenser nozzle at a flow rate selected by the user.

Alternately, the adjustable flow control can include a variable flow pump to dispense water from the dispenser nozzle at a flow rate selected by the user.

Another aspect of the present invention is directed to a variable flow rate water dispenser including a source of water and a dispenser housing mounted on a refrigerator door. The dispenser can include a nozzle for dispensing water from the dispenser housing and a user adjustable variable flow control controlling flow of water to the nozzle from the source of water. The user adjustable flow control can include a first water valve with a first flow rate and a second water valve having a second flow rate and an actuator. Operation of the actuator can cause the user adjustable flow control to operate the first water valve, the second water valve or both the first and second water valves depending on the flow rate selected by the user.

Another aspect of the present invention is directed to a variable flow rate water dispenser including a source of water and a dispenser housing mounted on a refrigerator door. The dispenser can include a nozzle for dispensing water from the dispenser housing, a variable flow pump controlling flow of water to the nozzle from the source of water and a user adjustable variable flow control. The user adjustable variable flow control can control operation of the variable flow pump and can include an actuator to cause the user adjustable flow control to operate the variable flow pump at a flow rate selected by the user.

The source of water can include a reservoir connected to a source of water to be automatically filled or can include a manually filled reservoir. The reservoir can be connected to the variable flow pump. The reservoir can also be expandable and can include a spring arranged to compress the reservoir.

The variable flow rate dispenser can include a user interface having a flow rate selector connected to the user adjustable variable flow control to allow a user to select a flow rate for the dispenser. The flow rate selector can include a touch pad control, plural switches or a potentiometer.

Another aspect of the present invention is directed to a dispenser housing mounted on a refrigerator door including a variable flow rate water dispenser and an ice dispenser. The variable flow rate water dispenser can include a reservoir connected to a source of water and a nozzle for dispensing water from the dispenser housing. The dispenser can include a control for dispensing water from the nozzle and for filling the ice maker including a user adjustable flow control. The user adjustable flow control can vary the flow rate of water supplied to the nozzle and can supply water to fill the ice maker.

DESCRIPTION OF THE INVENTION

The use of refrigerator water dispensers has changed with the advent of the addition of water filters to refrigerators for filtering the chilled water dispensed through an ice and water dispenser. Such water filters are known to improve the taste and appearance of water for user consumption. Consumers are now using filtered water from the refrigerator water dispenser instead of using sink mounted or countertop water filtration systems. Accordingly, consumers are requiring more flexibility and features from their refrigerator water dispenser. Uses for water dispensers now include filling of large containers for cooking and consumption. One result of the new uses for refrigerator water dispensers is the need for new ways to fill larger containers. This can be accomplished by providing a variable flow rate water dispenser to provide high flow rates for filling larger containers and slower flow rates for filling smaller containers or for filling an automatic ice maker. This can also be accomplished by providing a refrigerator freezer water system with minimal internal flow restrictions and with flow straightening features for the spigot. While the water dispenser according to the invention is disclosed as part of an ice and water dispenser for a refrigerator freezer, those skilled in the art should understand that the water dispenser according to the invention can be used as a water dispenser only, and not combined with an ice dispenser. Accordingly, the water dispenser according to the invention will be referred to as a water dispenser with the understanding that water dispenser is to be understood as referring to both a water dispenser and an ice and water dispenser. The water dispenser according to the invention can be used with a measured fill water dispenser as disclosed in co-pending patent application US20030018, Ser. No. 10/861,203, which patent application is incorporated by reference. The water dispenser according to the invention can also be used with a water dispenser having a movable spigot as disclosed in co-pending patent application US20030308, Ser. No. 10/860,906, which patent application is incorporated by reference.

Figure 1:
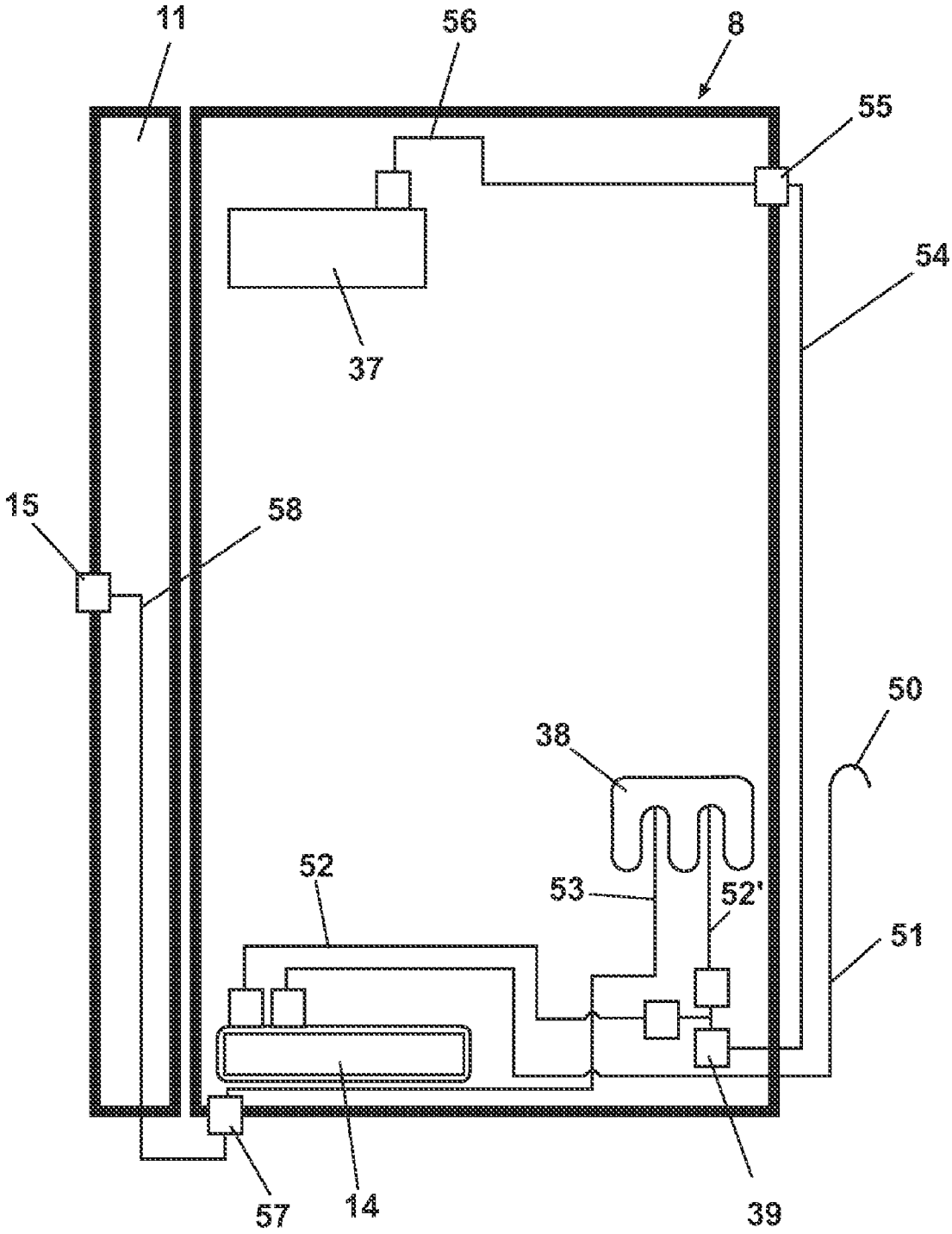
FIG. 1 is a schematic side view of a refrigerator having a variable flow rate water dispenser according to the invention showing the location of certain components.
Figure 1A:
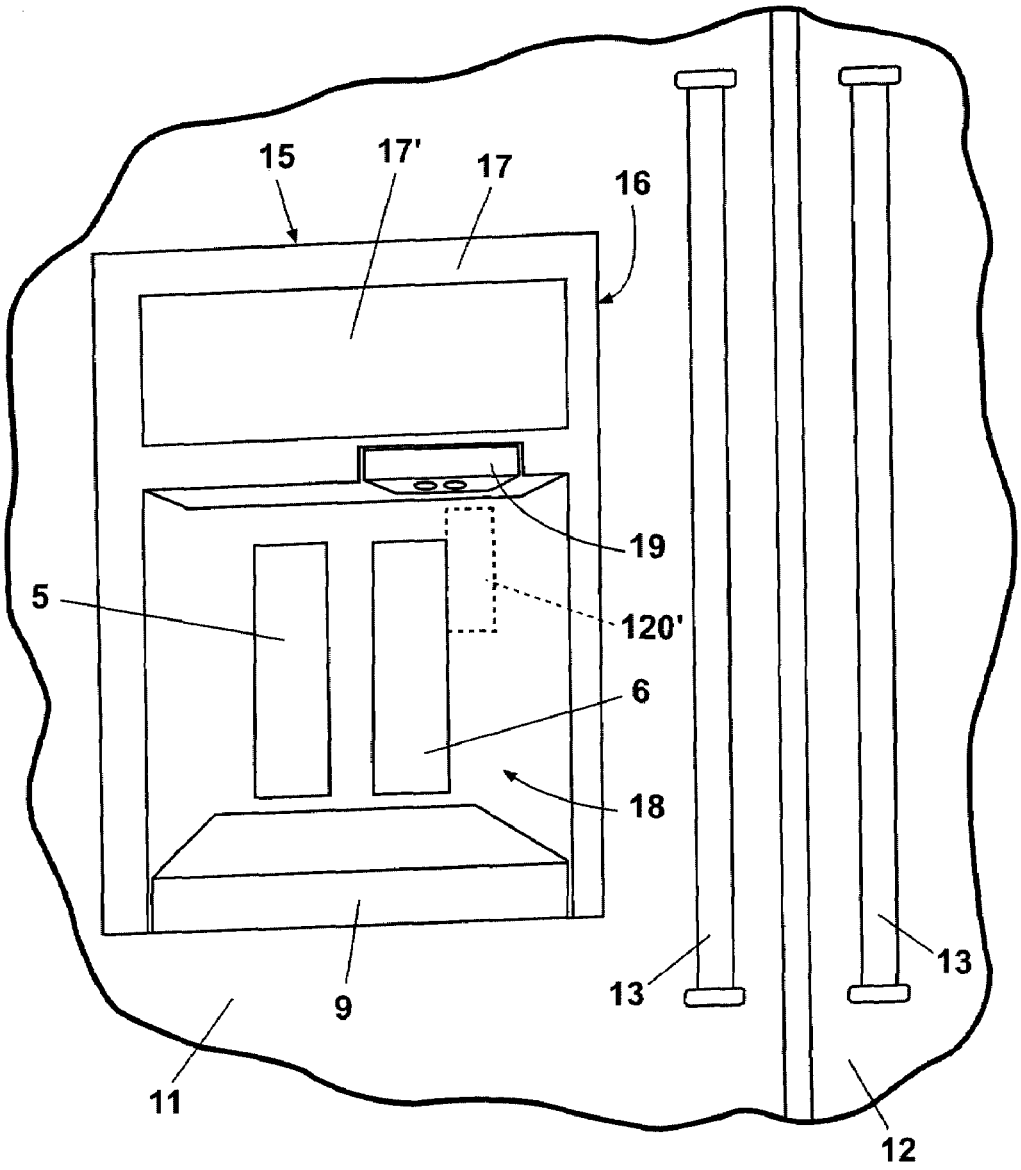
FIG. 1*a* is a partial front view of a refrigerator having a variable flow rate water dispenser according to the invention.
Figure 2:
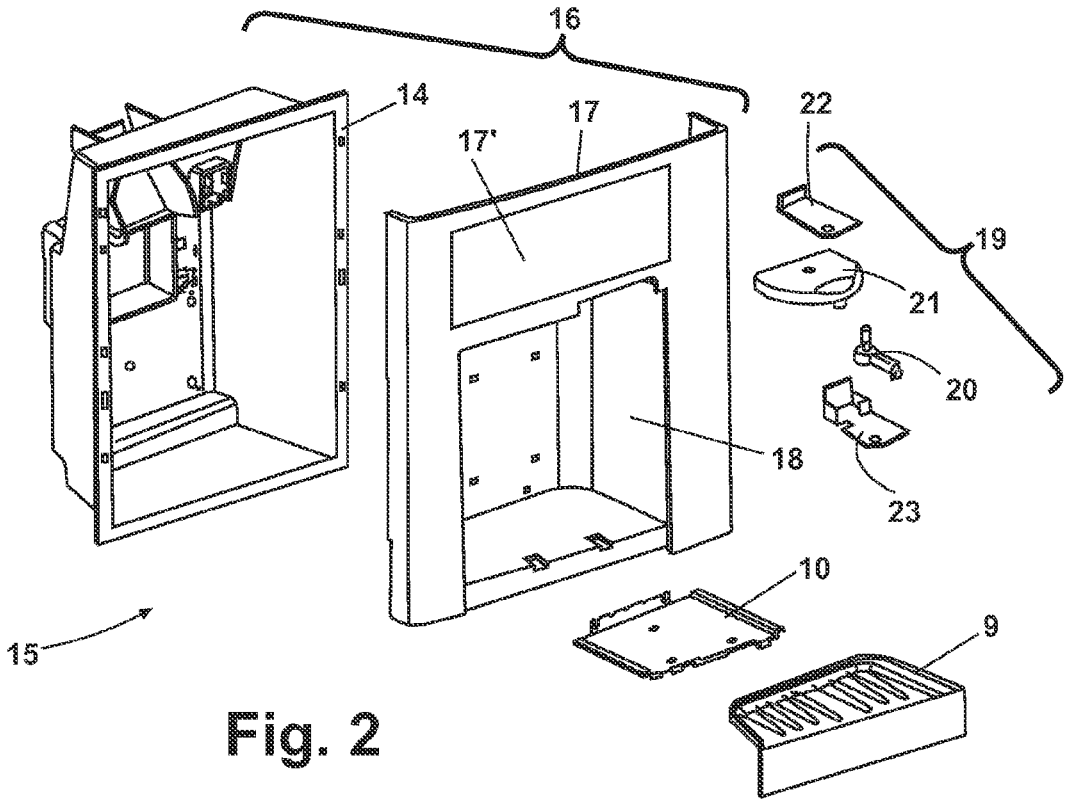
FIG. 2 is an exploded perspective view of a water dispenser housing according to the invention removed from the refrigerator.

Turning to FIG. 1, a refrigerator freezer 8 can be seen in a schematic side view to show the relative position of certain water dispenser components. Refrigerator freezer 8 can have a freezer door 11 that can include a water dispenser 15 on the face of the freezer door 11. While water dispenser 15 is shown on a side by side refrigerator freezer those skilled in the art will understand that the water dispenser can be used in conjunction with any refrigerator configuration, all refrigerator, top freezer, bottom freezer, or side by side configuration as shown in FIG. 1. Similarly, those skilled in the art with understand that the water dispenser 15 can be located on the face of the refrigerator door, not shown. Turning to FIG. 1*a* and FIG. 2, water dispenser 15 is shown on the freezer door 11 of a side by side refrigerator freezer. The refrigerator freezer can also have a refrigerator door 12. The freezer door 11 and refrigerator door 12 can have handles 13. Water dispenser 15 can include a dispenser housing 16 mounted in the face of freezer door 11. Dispenser housing 16 can include a dispenser enclosure 14 arranged to be mounted in freezer door 11 and a bezel 17. Bezel 17 can accommodate a water dispenser control and a user interface 17', not shown, that can be located at 17' all as described in co-pending U.S. Patent Application US20030018 referred to above. Bezel 17 or dispenser enclosure 14 can include a dispensing cavity 18 arranged to accommodate glasses and the like on a tray 9. Paddles or actuators 5 and 6 can be provided in the dispensing cavity 18 for actuating ice and water dispensing mechanisms respectively.

A water filter 14 can be positioned at the bottom of the refrigerator freezer 8, and can be accessible from the front of the refrigerator freezer for servicing. Those skilled in the art will understand that the water filter 14 can be located outside the refrigerated space accessible from the front of the refrigerator through a grill customarily provided to cover the space below the refrigerator and freezer compartment doors. Water filter 14 can also be located in an above freezing refrigerated space, if desired, such as in the refrigerator compartment, or in insulation for the refrigerator compartment, freezer compartment or in the insulation for the refrigerator or freezer compartment doors (collectively referred to as a "refrigerated space"), again as well known to those skilled in the art. An icemaker 37 can be located in the refrigerator freezer and arranged to freeze water to form ice pieces as is well known to those skilled in the art. In the embodiment of FIG. 1, water reservoir 38 can be positioned in refrigerator freezer 8 in a refrigerated space for cooling a quantity of water prior to dispensing through water dispenser 15 under control of valve assembly 39. The refrigerator freezer water system can be connected to a household water supply at connection end 50 via a compression fitting or other known connection arrangement to a household water system, not shown. Water line 51 can lead from connection end 50 to the inlet of water filter 14. Water line 52 can lead from water filter 14 to valve assembly 39 and water line 52' can lead from valve assembly 39 to reservoir 38. Water lines 51, 52, 52', 53 and 58 can be 5/16" diameter tubing to reduce flow restrictions and provide higher flow rates to the water dispenser 15 than ¼" tubing commonly used in household refrigerator freezers. Those skilled in the art will understand that ¼" tubing can be used for one or more of the supply lines schematically shown in FIG. 1 when desired flow rates can be achieved with the smaller tubing. Water line 53 can lead from reservoir 38 to fitting 57 at the bottom of refrigerator freezer 8 adjacent freezer door 11. Fitting 57 can include a suitable check valve to prevent back flow of water into reservoir 38. Water line 58 can lead from fitting 57 to water dispenser 15 and can pass through a hollow hinge pin supporting freezer door 11. Water line 54 can lead from valve assembly 39 to fitting 55 on the back wall of refrigerator freezer 8. Water line 56 can lead from fitting 55 to icemaker 37. Those skilled in the art will recognize that water lines 56 and 58 can be carried in a conduit through the insulation normally provided between the refrigerator freezer liner and cabinet and in the freezer door 11. While filter 14 is shown connected to the inlet of reservoir 38 in the embodiment of FIG. 1, those skilled in the art will understand that filter 14 can be connected to the outlet of reservoir 38 or elsewhere in the refrigerator freezer water system if desired.

Figure 4:
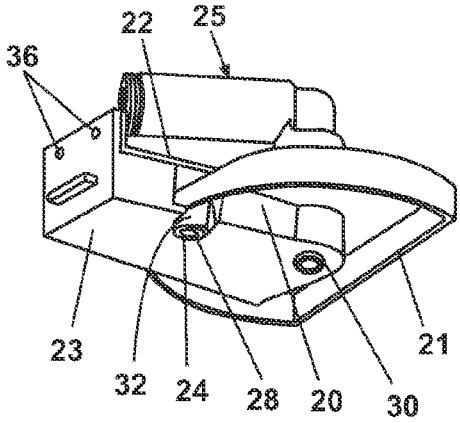
FIG. 4 is a rear perspective view of the water spout assembly removed from the dispenser housing shown in FIG. 2.
Figure 3:
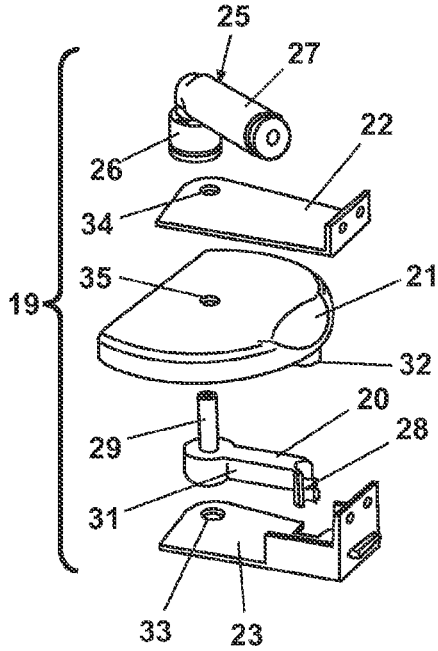
FIG. 3 is an enlarged exploded perspective view of the water spout assembly shown in FIG. 2.

Turning to FIG. 2 through FIG. 4, water dispenser 15 can include a dispenser housing 16 mounted in the face of freezer door 11. Dispenser housing 16 can include a dispenser enclosure 14 arranged to be mounted in freezer door 11 and a bezel 17. Bezel 17 can accommodate a user interface, not shown, that can be located at 17' and can be a user interface as described in co-pending U.S. Patent Application US20030018 referred to above. Bezel 17 can include a dispensing cavity 18 arranged to accommodate glasses and the like on a tray 9. According to the invention, a fixed spigot or a movable spigot 19 can be provided for the water dispenser that can be a movable spigot as described in co-pending patent application US20030308, filed concurrently with this application, which application is incorporated by reference. Dispenser housing 16 can include one or two dispenser paddles for actuating the ice dispenser or water dispenser as disclosed in co-pending patent application US20030018 referred to above. Alternately the user interface 17' can include an actuator for the ice dispenser and/or water dispenser again as disclosed in co-pending patent application US20030018 referred to above.

Spigot 19 is shown in the inner or home position in FIG. 4 and in an extended position in FIG. 2. A movable tray 9 can be movably mounted to dispenser housing 16 for movement between an inner dispensing position in the dispensing cavity and an outer dispensing position in front of the dispensing cavity. As shown in FIG. 2, tray 9 can be slidably mounted on a track 10 that can be mounted to housing 16 or bezel 17. Alternately, those skilled in the art will understand that a fixed tray can be used instead of a movable tray. Spigot 19 can be movably mounted to bezel 17 for movement between an inner position (FIG. 4) and an extended position (FIG. 2). Spigot 19 can include a spigot body 20 that can include an enlarged channel 31 leading from a pivot end 29 to flow straightening vanes 28. Spigot shroud 21 can include a semi-cylindrical wall 32 that can enclose flow straightening vanes 28 to form a fluid enclosure that can form a nozzle 24. Spigot body 20 and a spigot shroud 21 can be held together and supported on bezel 17 by upper bracket 22 and lower bracket 23. Spigot body 20 can include a mounting pin 30 that can be received in an opening 33 in lower bracket 23. Pivot end 29 of spigot body 20 can pass through an opening 35 in spigot shroud 21 and an opening 34 in upper bracket 22. Thus, spigot 19 can be held together by upper bracket 22 and lower bracket 23 when the brackets are mounted in bezel 17 with fasteners, not shown, that can pass through mounting holes 36. Pivot end 29 can be connected to the water system in the refrigerator, described below, via conduit assembly 25. Conduit assembly 25 can include a swivel interface arranged to be positioned on pivot end 29 to make a rotatable watertight connection with spigot body 20. Conduit assembly 25 can also include a check valve, not shown, in body 27 to prevent drips of water from nozzle 24 by preventing small forward and backward oscillations of water in the direction of water flow when the valve controlling water flow is closed. It is to be understood that while tray 9 can be drawn out to its extended position when spigot 19 is rotated to its extended position, tray 9 can be left retracted in dispensing cavity 18 when the user desires to fill a container too large to be positioned between nozzle 24 and tray 9 when they are both positioned in the extended position. While spigot 19 is shown in two positions in the embodiment of the invention shown in FIG. 2 through FIG. 4, spigot 19 can be provided with one or more detent stops between the inner and extended positions. Similarly, while spigot 19 can be manually movable between the inner and outer positions in the embodiment of FIG. 2 through FIG. 4, those skilled in the art that spigot 19 can be provided with a drive mechanism, not shown, that can include a stepper motor to drive the spigot between its inner and extended positions, and any intermediate positions. Likewise, tray 9 can be provided with a drive mechanism, not shown, to drive tray 9 between its inner and extended positions in conjunction with, or independently of, spigot 19.

Figure 5:
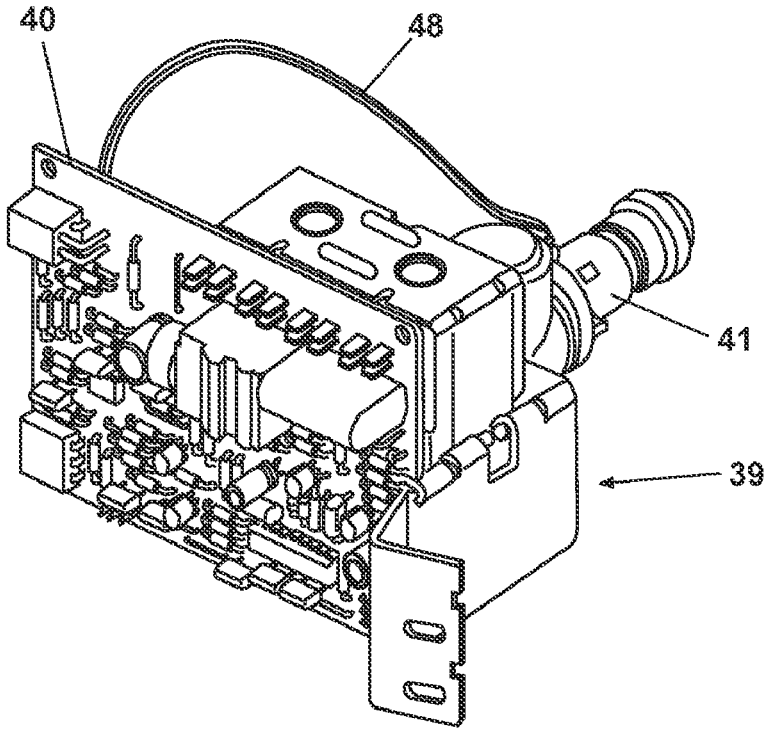
FIG. 5 is a rear perspective view of a water valve and valve control assembly according to the invention removed from the refrigerator.
Figure 6:
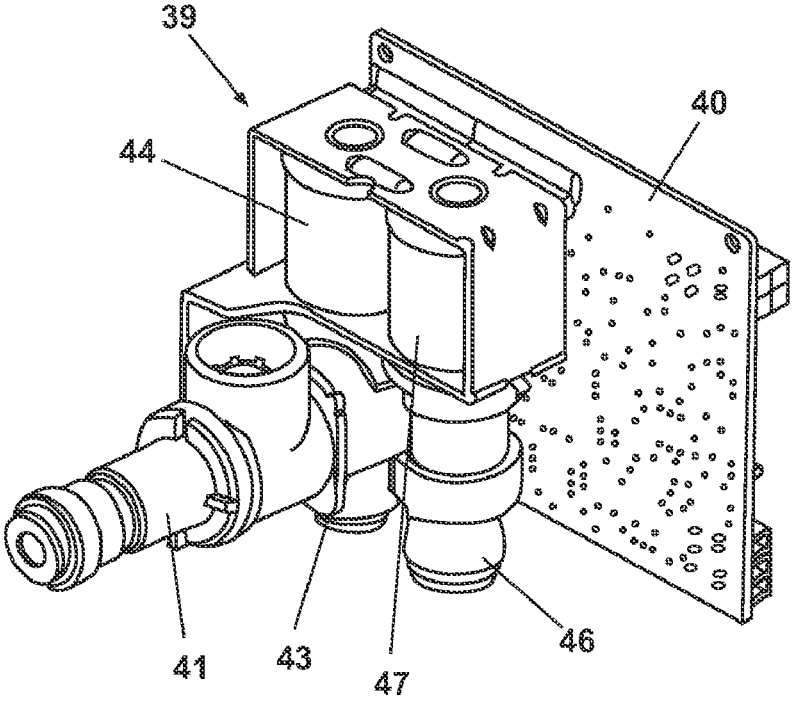
FIG. 6 is a front perspective view of the water valve and valve control assembly of FIG. 5.

Turning to FIG. 5 and FIG. 6, valve assembly 39 and valve control 40 can be seen removed from refrigerator freezer 8. Valve assembly 39 can include a first valve 43 having a solenoid 44 to actuate valve 43 and a second valve 46 with a solenoid 47 to actuate valve 46. Valve assembly 39 can also include a flow sensor 41 that can be positioned at the inlet to valve assembly 39 to measure flow of water through both valves 43 and 46. Flow sensor 41 can be a Hall Effect sensor well known in the art for sensing flow of water through a passage, and can be connected to valve control 40 by cable 48. The function of valve control 40 and flow sensor 41 in connection with measured fill dispensing of water is described in detail in co-pending patent application US20030018 referred to above. While two valves are shown in the embodiment of FIG. 5 and FIG. 6 those skilled in the art will understand that one or three or more valves can be provided in the valve assembly 39 in order to provide variable water dispenser flow rates as described below.

Valve 43 can be connected to water line 54 to supply water to icemaker 37 to commence an ice making cycle as is well known in the art. Valve 43 can be arranged to dispense a predetermined quantity of water into the ice maker mold, not shown, using the measured fill capability described above. A normal fill amount for an ice maker can be approximately 130 cubic centimeters ("cc") of water, although those skilled in the art will understand that the amount of water dispensed can be selected based on the capacity of the ice maker. Those skilled in the art will understand that the flow rate for valve 43 can be set to allow a water flow rate the icemaker can accommodate without splashing of water into the freezer compartment. The flow rate for valve 43 can be set to dispense 130 cc of water in 7.5 seconds at normal household water pressures. Those skilled in the art will appreciate that the measured fill control can allow dispensing of a predetermined amount of water into the ice maker mold regardless of household water supply pressure. As a backup, control 40 can be arranged to operate valve 43 for 7.5 seconds in the event valve control 40 detects abnormal operation of flow sensor 41. Valve 46 can be connected to water line 52' to supply water to reservoir 38 that in turn will cause water to flow from reservoir 38 to water dispenser 15. Valve 46 can be arranged to have a fill rate of 0.45 to 1.0 gallons per minute ("gpm") in the normal range of household water system pressures of 20-120 pounds per square inch ("psi"). Those skilled in the art will understand that water flow through a valve will vary depending on the supply pressure. For example, valve 46 can be arranged to deliver 0.85 gpm at 60 psi. Those skilled in the art will understand that valve 46 flow rates can be increased or decreased as desired. Likewise those skilled in the art will understand that valve 46 can be a variable flow valve with a flow rate controlled by a valve control 40, or can be a user manually adjusted flow rate valve as are well known in the art.

Figure 10:
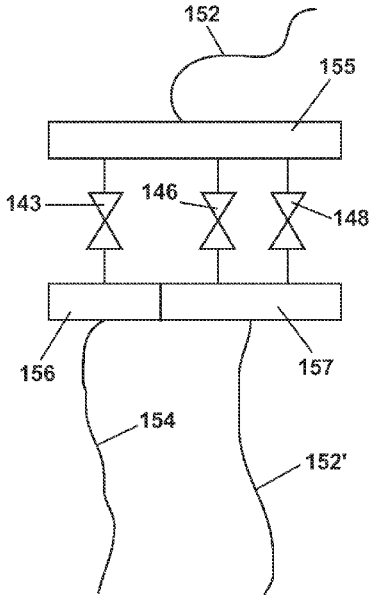
FIG. 10 is a partial schematic drawing of another embodiment of a valve assembly for providing variable fill rates.

Turning to FIG. 10 a plurality of valves can be connected to the ice and water dispenser to provide variable flow rates for the water dispenser. Water line 152 can lead from a water inlet or from a water filter, not shown, to an inlet chamber 155. In the embodiment of FIG. 10 three valves 143, 146 and 148 can be connected to inlet chamber 155 to receive water from water line 152. While inlet chamber 155 is shown to provide water to a plurality of valves those skilled in the art will understand that other arrangements can be made to provide water to the plural valves including but not limited to a manifold connecting water line 152 with the plural valves 143, 146 and 148. Those skilled in the art will also understand that a flow sensor can be provided at the inlet to inlet chamber 155 or at the inlet of one or more of valves 143, 146 and/or 148 as shown in FIG. 5 and FIG. 6. First valve 143 can be connected to ice maker outlet chamber 156 that can be connected to water line 154 that can lead to an ice maker, not shown. Those skilled in the art will understand that water line 154 can be connected directly to first valve 143. Second valve 146 and third valve 148 can be connected to water dispenser outlet chamber 157. Water dispenser outlet chamber 157 can be connected to a water line 152' leading to a water dispenser, not shown. Those skilled in the art will understand that other arrangements can be made to gather water from valves 146 and 148 including but not limited to a manifold connecting water line 152' with valves 146 and 148. First valve 143 can have a flow rate suitable for filling an ice maker cavity without splashing water into the freezer compartment. The flow rate for first valve 143 can be in the range 0.24 to 0.30 gpm at 60 psi to provide approximately 130 cc of water in 7.5 seconds as described above. Alternately, first valve 143 can be operated by a valve control including a flow sensor as described above to dispense a predetermined amount of water to fill the ice maker cavity as described above. Second valve 146 can have a flow rate selected to provide for a "slow" fill rate for the water dispenser. Third valve 148 can have a flow rate selected to provide a "medium" fill rate. Second valve 146 and third valve 148 can be operated together to provide a "high" fill rate. The "slow" fill rate can be as low as 0.25 gpm at 60 psi and the "high" fill rate can be as high as 1.5 gpm at 60 psi. Typically flow rates to the water dispenser can be selected to range from 0.45 gpm to 1.0 gpm for water supply pressures ranging from 20 to 120 psi. In one embodiment, the "slow" fill rate can be 0.35 gpm at 60 psi, the "medium" fill rate can be 0.5 gpm at 60 psi and the "high" fill rate can be 0.85 gpm at 60 psi. Those skilled in the art will understand that the actual flow rates may vary slightly depending on flow restrictions in the dispenser system such as a filter or a reservoir. Valves 143, 146 and 148 can be connected to a valve control and control system as disclosed in co-pending patent application US20030018 incorporated herein by reference in order to deliver water to the water dispenser at a flow rate selected by the consumer. Those skilled in the art will also understand that more than three valves can be provided in the valve arrangement of FIG. 10 when more than three fill rates are desired.

Figure 11A:
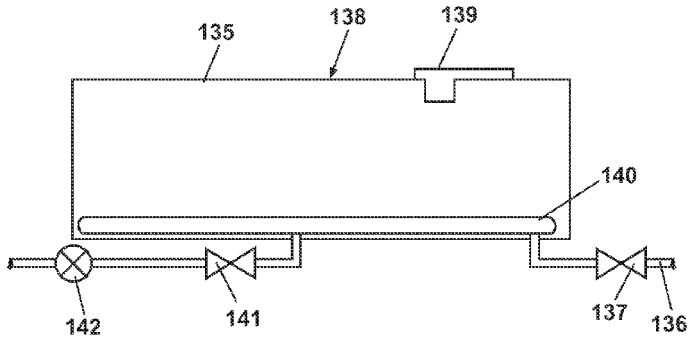
FIG. 11A is a partial schematic drawing of an alternate embodiment of a reservoir and pump for providing variable fill rates.
Figure 11B:
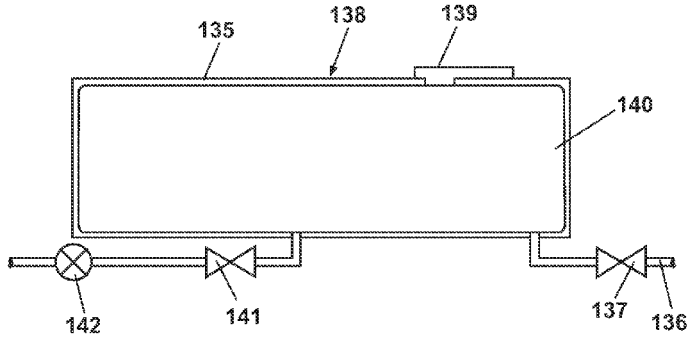
FIG. 11B is a partial schematic drawing of the alternate embodiment of FIG. 11A showing the reservoir full of water.
Figure 12:
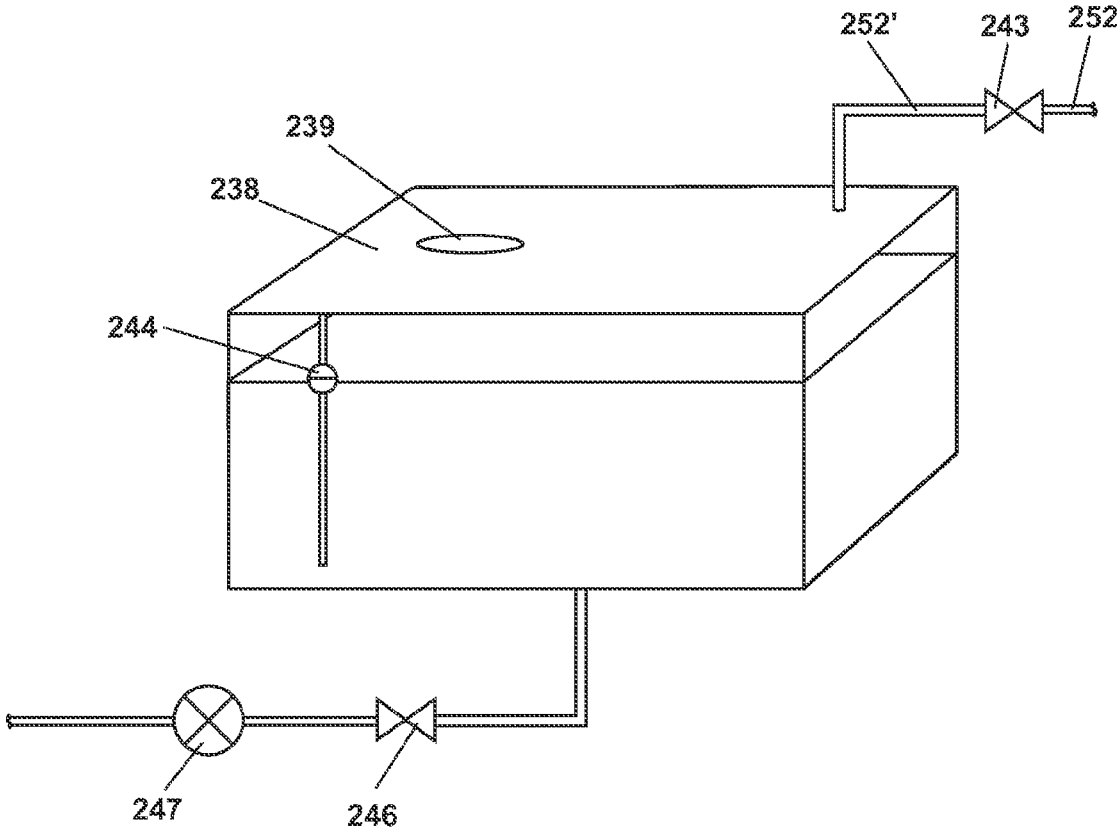
FIG. 12 is a partial schematic drawing of an alternate embodiment of a reservoir and pump for providing variable fill rates.

A variable flow rate for the water dispenser can also be achieved by using a water pump to supply water to a water dispenser from a reservoir. Turning to FIG. 11A, FIG. 11B and FIG. 12 two variable flow embodiments utilizing a pump can be seen. The embodiment of FIG. 11A and FIG. 11B can have a reservoir 138 that can be located in a refrigerated space to provide a supply of cold water for the water dispenser. Reservoir 138 can include a container 135 having a flexible bladder 140 positioned in the container that can expand as it is filled with water to substantially fill container 135 as shown in FIG. 11B. Bladder 140 can be formed of a NSF approved material with elastic properties. Bladder 140 can be connected to an inlet line 136 that can be connected to water line 51 (FIG. 1) that can be connected to the household water system, not shown. Valve 137 can be connected between water line 136 and bladder 140 to control flow of water into bladder 140. A sensor 139 can be provided to detect when bladder 140 is full as shown in FIG. 11B. Those skilled in the art will understand that sensor 139 can be a mechanically operated switch or other well known sensor arranged to detect when bladder 140 has expanded to fill container 135. Those skilled in the art will understand that container 135 can be substantially closed enclosure having at least a vent to allow bladder to freely expand and contract within the container 135. Alternately, container 135 can be foraminous to provide support for bladder 140 when the bladder material is sufficiently rugged to not require enclosure for protection.

Flow of water out of reservoir 138 can be controlled by a valve 141 and/or a variable flow pump 142. Those skilled in the art will understand that valve 141 can be omitted, or can be used alone without variable flow pump 142. For example, when reservoir 138 is located below the water dispenser on the face of a refrigerator door and a variable flow pump 142 is used a valve 141 may not be necessary. However, when reservoir 138 is located above the water dispenser on the face of a refrigerator door, or when local codes require such a valve, a valve 141 can be used in conjunction with variable flow pump 142. Likewise, variable flow pump 142 can be eliminated and valve 141 can be a variable flow valve controlled by a valve control such as valve control 40 to provide a user selected flow rate, or can be a manually user adjusted valve. Variable flow pump 142 can be arranged to deliver water to a water dispenser at predetermined rates. For example, variable flow pump can be arranged to deliver water at rates from 0.25 gpm to 1.5 gpm as in the case of the embodiment of FIG. 10. Those skilled in the art will recognize that variable delivery pumps are well known in the art and that such pumps can be arranged to deliver water over a wide range of flow rates as desired. Those skilled in the art will also understand that variable flow pump 142 can be connected to deliver water to an ice maker as well as to a water dispenser by provision of a two way valve connecting the pump to one or the other of the ice maker or water dispenser. Variable flow pump 142 can be arranged to provide continuously variable flow rates over a selected range, or can be arranged to deliver discrete flow rates such as 0.35 gpm, 0.5 gpm and 0.85 gpm as in the FIG. 10 embodiment. As mentioned above, valve 141 can be a variable flow valve and can be arranged to deliver similar flow rates. Those skilled in the art will understand that variable flow pump 142 can be replaced by a single flow rate pump combined with a variable flow valve 141 as described above to provide user selected discrete or continuously variable flow rates. Valves 137 and 141, sensor 139 and pump 142 can be connected to a control system as disclosed in co-pending patent application US20030018 incorporated herein by reference in order to maintain bladder 140 full and to cause valve 141 and/or variable flow pump 142 to deliver water to the water dispenser at a flow rate selected by the consumer. One advantage of the embodiment of FIG. 11A and FIG. 11B is the ability to deliver flow rates greater than the incoming water supply flow rate since the capacity of bladder 140 can be arranged to be larger than amounts of water expected to be dispensed in a single operation.

Another embodiment of a variable flow rate dispenser reservoir can be seen in schematic form by referring to FIG. 12. The embodiment of FIG. 12 can include a reservoir 238 that can be located in a refrigerated space to provide cold water to a water dispenser. Those skilled in the art will understand that, alternately, reservoir 238 can be located outside of a refrigerator if desired. Locating reservoir 238 outside a refrigerator can be advantageous when the reservoir is arranged to be manually filled as described below. Reservoir 238 can include an opening 239 to the atmosphere to allow water to flow into and out of reservoir 238 at different rates. While opening 239 is shown in FIG. 12 as a round hole, those skilled in the art will understand that opening 239 can take the form of a vent or siphon break to allow reservoir 238 to fill or empty freely. Reservoir 238 can be provided with a water line 252' leading from a water valve 243 that can be connected to a water line 252 leading to the household water supply, not shown. Reservoir 238 can be provided with a level sensor 244 to determine the level of water in the reservoir 238. While level sensor 244 is shown as a float sensor in FIG. 12, those skilled in the art will understand that other level sensors such as a pressure switch, a capacitive sensor or field effect sensor as are well known in the art can be used in place of sensor 244 as desired. Reservoir 238 can also be arranged to be manually filled in lieu of connecting the reservoir to the household water supply. Opening 239 can take the form of a removable cover or cap to facilitate manual filling of reservoir 238. Manual filling might be desired in locations where the household water supply is unsatisfactory for any number of reasons including taste, mineral content, odor and/or appearance making bottled water a desirable choice. Those skilled in the art will understand that reservoir 238 can be provided with a filter, not shown, that can be a gravity filter positioned to filter water as it is added to reservoir 238 at opening 239. Those skilled in the art will also understand that a filter, not shown, can be connected in the water circuit with reservoir 238 and the water dispenser on the refrigerator door, not shown. Those skilled in the art will understand that when reservoir 238 is arranged for manual filling, reservoir 238 can be positioned in refrigerator 8 to facilitate manual filling of the reservoir, or can be positioned outside the refrigerator if desired. Reservoir 238 could take the form of a bottled water dispenser well known in the art and located adjacent the refrigerator as will be readily understood by those skilled in the art. Valve 243, if provided, and a sensor, 244 can be connected to a control system as disclosed in co-pending patent application US20030018 incorporated herein by reference in order to maintain reservoir 238 filled, or if arranged for manual filling to indicate that the reservoir should be refilled. As with the embodiment of FIG. 11A and FIG. 11B, reservoir 238 can be provided with a valve 246 and/or a variable flow pump 247, as desired, to provide water to the water dispenser at a flow rate selected by the user. Likewise, valve 246 and/or variable flow pump 247 can be arranged to deliver water to an ice maker as well as to a water dispenser.

Figure 13A:
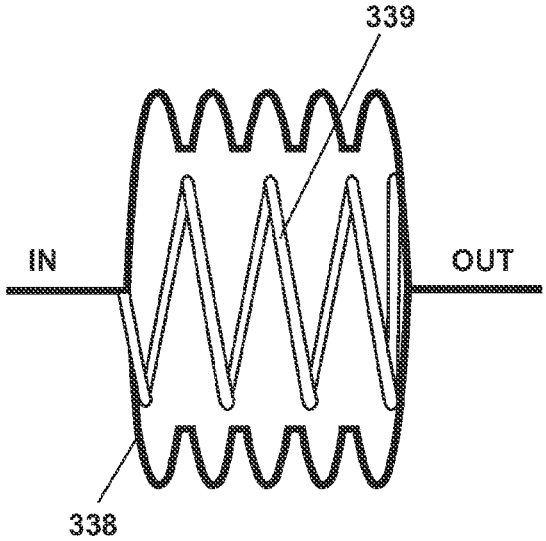
FIG. 13A is a partial schematic drawing of an alternate embodiment of a reservoir for providing variable fill rates showing the reservoir expanded.
Figure 13B:
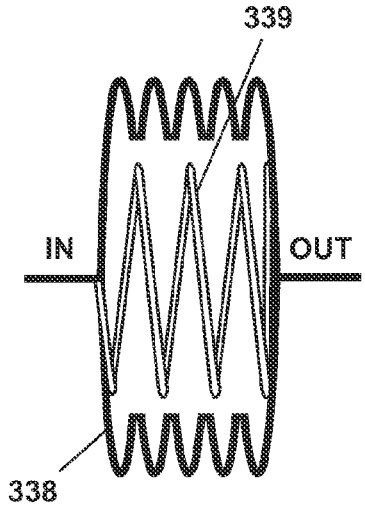
FIG. 13B is a partial schematic drawing of an alternate embodiment of a reservoir for providing variable fill rates showing the reservoir contracted.

Another embodiment of a reservoir for a water dispenser can be seen in schematic form by referring to FIG. 13A and FIG. 13B. Reservoir 338 can be an expandable tank, that when connected to inlet and outlet water lines is closed to the atmosphere as with the case of reservoir 38 in FIG. 1. Reservoir 338 can expand and contract as water is added and removed from the tank at different rates. Reservoir 338 can be provided with a spring 339 arranged to compress the tank toward the position shown in FIG. 13B. Water supplied to the tank can expand the tank toward the position shown in FIG. 13A overcoming the spring 339 tending to compress the tank. Providing reservoir 338 with a spring 339 can be an advantage for use in home water systems with adequate pressure but low flow rates. The pressure in the home water system may be adequate to expand and fill reservoir 338 over time. The system pressure combined with pressure from the spring can be sufficient to dispense water at a selected flow rate, as described above, that can be greater than the available household water system flow rate, when a valve or valves controlling flow to the water dispenser is/are opened. Those skilled in the art will understand that the inlet diameter can be smaller than the outlet diameter to allow higher flow rates of water out of the reservoir. Use of a larger outlet than inlet can provide an initial period of high flow rate, although, depending on the size of the reservoir, the high flow rate may drop to a flow rate corresponding to the available household water supply. While the embodiment of FIG. 13A and FIG. 13B shows a spring 339, those skilled in the art will understand that reservoir 338 need not include a spring 339 when reservoir 338 is formed of a resilient material having a "memory" tending to compress reservoir 338 to the compressed position in FIG. 13B obviating the need for spring 339; when low flow rate water systems are not a concern; or when reservoir 338 is intended to be used with a variable flow pump as in the embodiments of FIG. 11A, FIG. 11B and FIG. 12.

Figure 14:
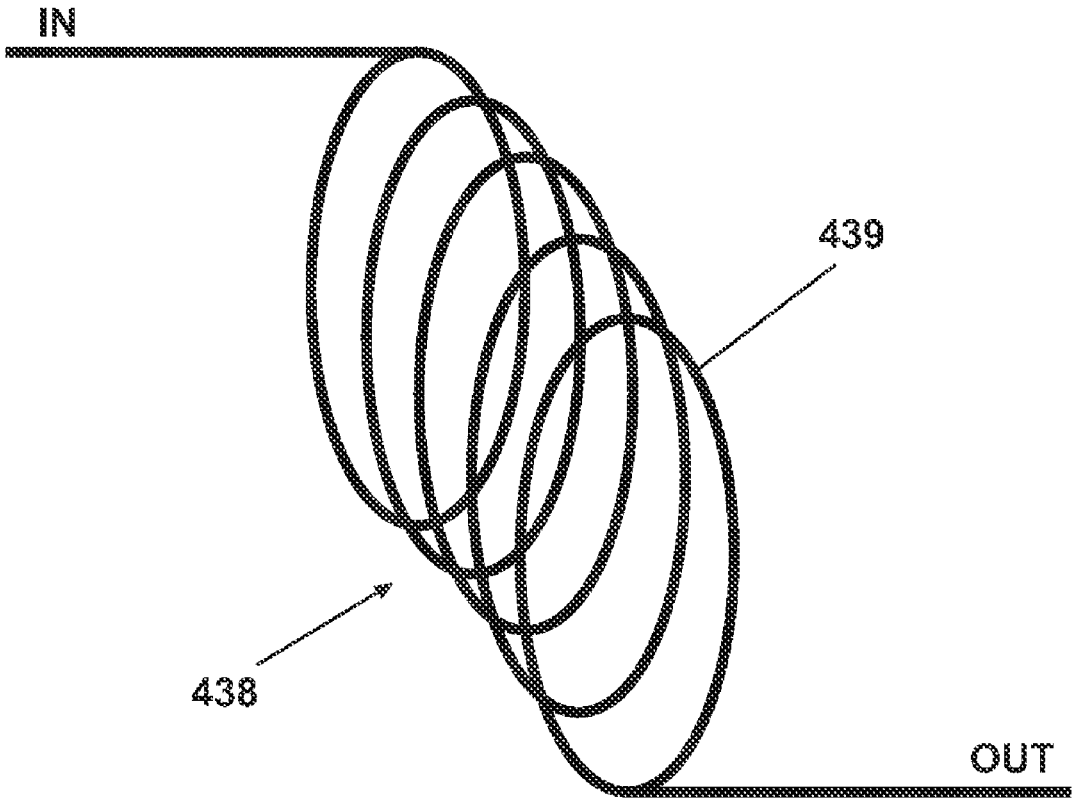
FIG. 14 is a partial schematic drawing of an alternate embodiment of a reservoir that can be used with the variable flow rate dispenser according to the invention.

Those skilled in the art will understand that a tank reservoir as shown in FIG. 1 can be replaced with a coiled tubing reservoir 438 as shown in FIG. 14. The tubing 439 forming reservoir 438 can be formed of material that does not have good conductive properties such as polyethylene or can be formed of conductive material such as copper tubing. Those skilled in the art will understand that the reservoir can be placed in the refrigerator 8 in a refrigerated space where efficient heat exchange can take place to cool the water in the coiled tubing. Likewise, those skilled in the art will understand the diameter and number of coils of tubing can be selected to provide a reservoir holding the desired amount of water. Those skilled in the art will understand that use of a conductive material such as copper can enable a substantially endless supply of cold water provided the coil is arranged for adequate heat exchange, while an non-conductive coil serves as a chilled water holding tank that can be depleted. When a non-conductive holding tank is used warm water can be dispensed until sufficient time has passed for water in the holding tank to cool down.

Figure 7:
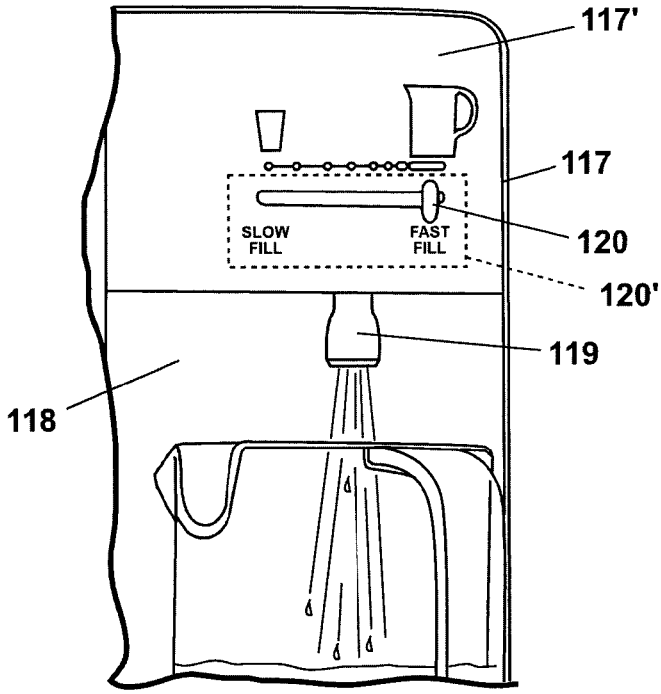
FIG. 7 is a partial front view of another embodiment of water dispenser according to the invention.
Figure 8:
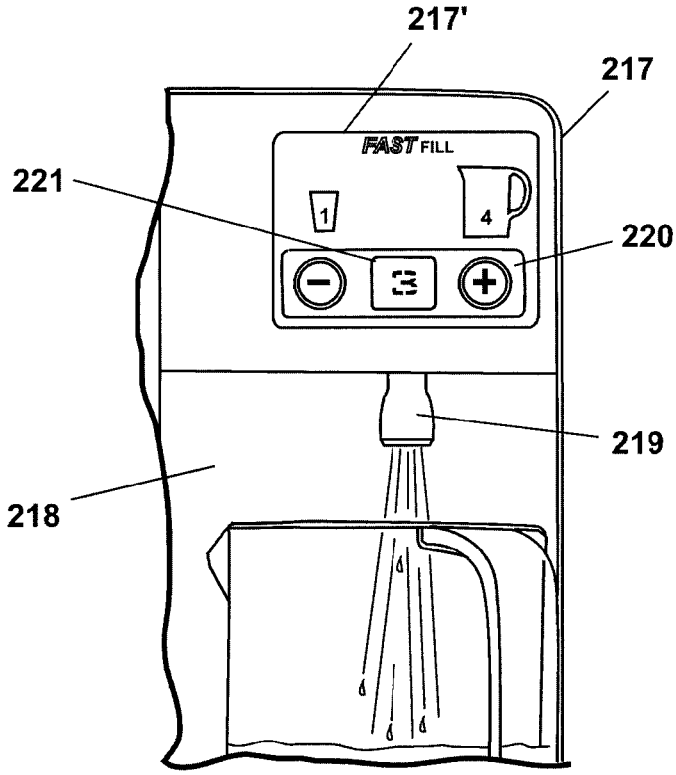
FIG. 8 is a partial front view of another embodiment of water dispenser according to the invention.

Turning to FIG. 7 and FIG. 8, alternate embodiments of user interfaces for variable flow water dispensers can be seen. In FIG. 7 bezel 117 can include user interface 117' that can include a flow rate selector 120. Flow rate selector 120 can be a slider of a multiple contact switch or a potentiometer 120' to position the multiple contact switch or to adjust the potentiometer 120' connected in a control circuit, not shown, for a variable flow pump as disclosed in the embodiments of FIG. 11A, FIG. 11B and FIG. 12. Use of multiple position switches or a potentiometer in a control circuit to control the speed of a variable speed pump are well known in the art. As a user selects a container size/fill rate by moving flow rate selector 120, a control circuit, not shown, can cause the water dispenser to dispense water from spigot 119 at the selected flow rate. In FIG. 8 bezel 217 can include user interface 217' that can include a flow rate selector 220. Flow rate selector 220 can be a touch pad controller having "+" and "−" pads to adjust the flow rate. User interface 217' can include a user display 221 to display the selected flow rate. The user interface 217' of FIG. 8 can be used with a variable flow rate valve arrangement such as disclosed in the embodiment of FIG. 10 or the variable flow pump embodiments of FIG. 11A, FIG. 11B and FIG. 12. Instead of flow rate selector 120 as in FIG. 7, a paddle, similar to paddle 6 in FIG. 1*a*, in dispenser cavity 18 can be arranged to be the actuator of a multiple position switch or potentiometer 120' as in FIG. 7 to actuate the plurality of switches or the potentiometer 120' as the user presses against the paddle to cause the dispenser control to dispense water. Pressing the paddle further into the dispenser cavity can cause the dispenser control to increase flow rate in the same manner as sliding flow rate selector 120 or can cause the dispenser control to increase the flow rate in discrete steps as in the embodiment of FIG. 10.

Figure 9B:
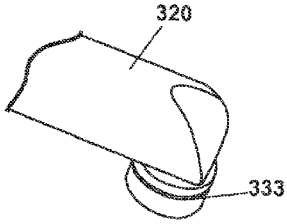
FIG. 9B is a partial perspective view of the nozzle of the water spigot embodiment of FIG. 9A.
Figure 9C:
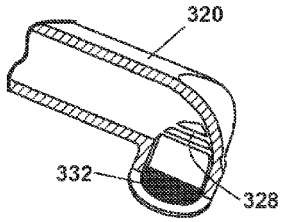
FIG. 9C is a partial sectional view of the nozzle of the water spigot embodiment of FIG. 9A.
Figure 9D:
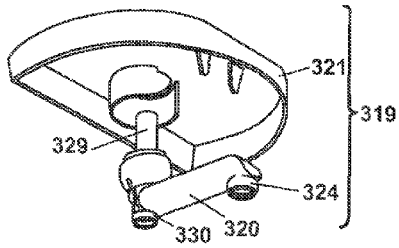
FIG. 9D is a partial exploded view of the water spigot assembly of FIG. 9A.
Figure 9A:
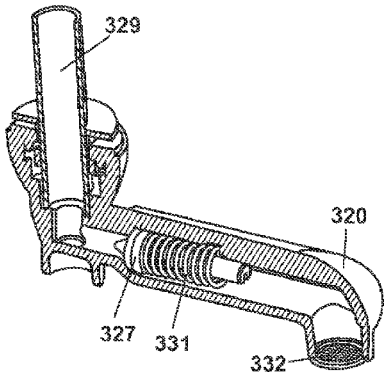
FIG. 9A is a partial sectional view of another embodiment of the water spigot assembly.
Figure 9E:
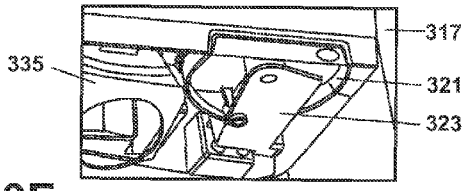
FIG. 9E is partial bottom perspective view of the water spigot assembly of FIG. 9A with the spigot in the home position.
Figure 9F:
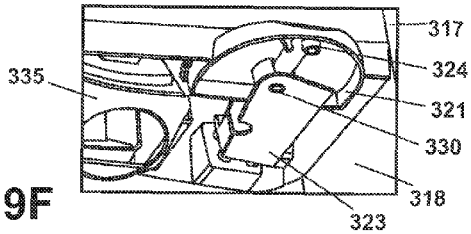
FIG. 9F is a partial bottom perspective view of the water spigot assembly of FIG. 9A with the spigot in the extended position.

Turning to FIG. 9A through 9F another embodiment of a spigot can be seen. Referring to FIG. 9A and FIG. 9D, spigot 319 can include a spigot body 320 leading from pivot end 329 to nozzle 324. As shown in FIG. 9C spigot body 320 can include flow straightening vanes 328 adjacent nozzle 324. Nozzle 324 can include an aerator screen 332 adjacent the outlet of nozzle 324. Nozzle 324 can also include one or more aerator air intakes 333 adjacent and above screen 332 and below flow straightening vanes to inject air into the stream of water flowing out of nozzle 324 to a minimize splashing as water is dispensed into a container. Nozzle 324 can be enlarged relative to the spigot body 320 in order to decrease the outlet velocity of water from the nozzle. Those skilled in the art will understand that a suitable flow restrictor, not shown, can be included in nozzle 324, or if desired elsewhere in the system such as a flow washer in a water valve, for use in jurisdictions having water flow control regulations requiring such flow restrictors. Referring to FIG. 9E and FIG. 9F, spigot 319 including spigot body 320 and spigot shroud 321 can mounted in bezel 317 by lower bracket 323 and an upper bracket, not shown, similar to spigot 19 in FIG. 1. Also shown in FIG. 9E and FIG. 9F is an ice dispenser chute 335 that can be provided in bezel 317 when an ice dispenser is included with a water dispenser.

Returning to FIG. 9A, a check valve 327 can be provided in spigot body 320 to prevent drips from the spigot by preventing small forward and backward oscillations of water in the direction of flow when the valve is shut. Check valve 327 can be held against a seat formed in spigot body 320 by a check valve spring 331. When the water dispenser is activated the flow of water through pivot end 329 into spigot body 320 is sufficient to open check valve 327 to allow water to flow into and out of nozzle 324. When water dispensing is complete and flow of water stops check valve 327 again closes as is well known in the art. Spigot 319 can be provided with a swivel interface, not shown, like that in the embodiment shown in FIG. 2 to allow spigot 319 to be rotated between the inner or home position (FIG. 9E) and the extended position (FIG. 9F). As described in connection with the embodiment of FIG. 2, spigot 319 can be manually movable between the inner and extended positions, or can be provided with a drive mechanism to move the spigot between the inner and extended, and if desired one or more intermediate positions.

While the invention has been specifically described in connection with certain specific embodiments thereof, it is to be understood that this is by way of illustration and not of limitation, and the scope of the appended claims should be construed as broadly as the prior art will permit.

We claim:

1. A variable flow rate water dispenser for a refrigerator comprising:

a water source including a reservoir;

a dispenser housing mounted on a refrigerator door;

a nozzle for dispensing water from the dispenser housing;

a variable flow pump controlling a water flow rate to the nozzle from the water source;

a user adjustable variable flow control connected to control operation of the variable flow pump;

an actuator, wherein operation of the actuator causes the user adjustable flow control to operate the variable flow pump; and a user interface having a flow rate selector including a manually adjustable potentiometer for selecting flow rates from slow fill to fast fill, wherein adjustment of the flow rate selector causes the user adjustable flow control to operate the variable flow pump at the water flow rate selected by the user.

2. A variable flow rate water dispenser for a refrigerator comprising:

a refrigerator control;

a water source including a reservoir comprising:

a container having an expandable bladder positioned inside the container and connected to the source of water and to the variable flow pump;

a sensor;

an inlet valve; and wherein the sensor and inlet valve are connected to the refrigerator control to add water to the reservoir when the bladder is not in contact with the sensor;

a dispenser housing mounted on a refrigerator door;

a nozzle for dispensing water from the dispenser housing;

a variable flow pump controlling a water flow rate to the nozzle from the water source;

a user adjustable variable flow control connected to control operation of the variable flow pump;

an actuator, wherein operation of the actuator causes the user adjustable flow control to operate the variable flow pump; and a user interface having a flow rate selector, wherein adjustment of the flow rate selector causes the user adjustable flow control to operate the variable flow pump at the water flow rate selected by the user.

3. The variable flow rate water dispenser of claim 2 further including an outlet valve connected to the reservoir and the variable flow rate pump, and wherein the outlet valve is connected to the variable flow control to open the outlet valve to supply water to the variable flow pump when the dispenser is activated at the user selected rate regardless of an inlet flow rate.

4. A variable flow rate water dispenser for a refrigerator comprising:

a refrigerator control;

a water source including a reservoir comprising:

a manually fillable container connected to the variable flow pump;

a sensor; and wherein the sensor is connected to the refrigerator control to provide a signal to add water to the reservoir when a water level in the container falls to a predetermined level;

a dispenser housing mounted on a refrigerator door;

a nozzle for dispensing water from the dispenser housing;

a variable flow pump controlling a water flow rate to the nozzle from the water source;

a user adjustable variable flow control connected to control operation of the variable flow pump;

an actuator, wherein operation of the actuator causes the user adjustable flow control to operate the variable flow pump; and a user interface having a flow rate selector, wherein adjustment of the flow rate selector causes the user adjustable flow control to operate the variable flow pump at the water flow rate selected by the user.

5. The variable flow rate water dispenser of claim 4 further including an outlet valve connected to the reservoir and the variable flow pump, and wherein the outlet valve is connected to the variable flow control to open the outlet valve to supply said water to the variable flow pump when the dispenser is activated at the user selected rate regardless of an inlet flow rate.

6. A variable flow rate water dispenser for a refrigerator comprising:

a refrigerator control;

a water source including a reservoir comprising:

a container connected to the source of water and to the variable flow pump and including an atmospheric vent;

a sensor;

an inlet valve; and wherein the sensor and inlet valve are connected to the refrigerator control to operate the inlet valve to add water to the reservoir when a water level in the container falls to a predetermined level;

a dispenser housing mounted on a refrigerator door;

a nozzle for dispensing water from the dispenser housing;

a variable flow pump controlling a water flow rate to the nozzle from the water source;

a user adjustable variable flow control connected to control operation of the variable flow pump;

an actuator, wherein operation of the actuator causes the user adjustable flow control to operate the variable flow pump; and a user interface having a flow rate selector, wherein adjustment of the flow rate selector causes the user adjustable flow control to operate the variable flow pump at the water flow rate selected by the user.

7. The variable flow rate water dispenser of claim 6 further including an outlet valve connected to the reservoir and the variable flow pump, and wherein the outlet valve is connected to the variable flow control to open the outlet valve to supply said water to the variable flow pump when the dispenser is activated at the user selected rate regardless of an inlet flow rate.

8. A variable flow rate water dispenser for a refrigerator comprising:

a water source including a reservoir, wherein the reservoir is expandable and includes a spring arranged to compress the reservoir;

a dispenser housing mounted on a refrigerator door;

a nozzle for dispensing water from the dispenser housing;

a variable flow pump controlling a water flow rate to the nozzle from the water source;

a user adjustable variable flow control connected to control operation of the variable flow pump;

an actuator, wherein operation of the actuator causes the user adjustable flow control to operate the variable flow pump; and a user interface having a flow rate selector, wherein adjustment of the flow rate selector causes the user adjustable flow control to operate the variable flow pump at the water flow rate selected by the user.

9. The variable flow rate water dispenser of claim 8 further including an outlet valve connected to the reservoir and the variable flow pump, wherein the outlet valve is connected to the variable flow control to open the outlet valve to supply said water to the variable flow pump when the dispenser is activated at the user selected rate regardless of an inlet flow rate.

10. A variable flow rate water dispenser for a refrigerator comprising:

a water source including a reservoir;

a dispenser housing mounted on a refrigerator door;

a nozzle for dispensing water from the dispenser housing;

a variable flow pump controlling a water flow rate to the nozzle from the water source;

a user adjustable variable flow control connected to control operation of the variable flow pump;

a paddle positioned in the dispenser housing adjacent the nozzle; and a flow rate selector including a potentiometer operated by the paddle, wherein when the paddle is displaced the dispenser is activated and the water flow rate is determined by an amount of paddle displacement.

* * * * *